United States Patent [19]

Friedman

[11] Patent Number: 4,679,274

[45] Date of Patent: Jul. 14, 1987

[54] FINGER MANIPULATED ORAL HYGIENE DEVICE

[76] Inventor: Jack C. Friedman, 750 W. Broadway #809, Vancouver, British Columbia, Canada, V5Z 1H7

[21] Appl. No.: 758,652

[22] Filed: Jul. 24, 1985

[51] Int. Cl.[4] ..... A46B 9/04

[52] U.S. Cl. ..... 15/167 R; 15/227

[58] Field of Search ..... 15/167 R, 167 A, 143 R, 15/110, 227, 104.94

[56] References Cited

U.S. PATENT DOCUMENTS 2,968,827 1/1961 Lawsine et al. ..... 15/227 X

FOREIGN PATENT DOCUMENTS 601773 12/1925 France ..... 15/227
2491309 4/1982 France ..... 15/167 R
1286416 8/1972 United Kingdom ..... 15/167 R

*Primary Examiner*—Peter Feldman

*Attorney, Agent, or Firm*—Mason, Fenwick & Lawrence

[57] ABSTRACT

An oral hygiene device for mounting on and manipulated by a user's finger comprises a stem, an oral hygiene working head and a clamp for mounting the device on a user's finger. The working head is provided at one end of the stem and the mounting clamp provided at the other end of the stem. The stem includes a stepped portion between the working head and the mounting clamp to elevate thereby a portion of the stem provided with the working relative to the clamps so as to provide a working head essentially as an extension of the finger. The clamp may be formed of plastic having two pairs of opposing lugs. The plastic may be sufficiently resilient to conform to the shape of the user's finger to ensure an adequate secure mounting of the finger. The oral hygiene device of this construction provides a new mode for the delivery of improved oral hygiene to facilitate a quick and accurate arrival at predetermined destinations of the gum tooth junction.

11 Claims, 7 Drawing Figures

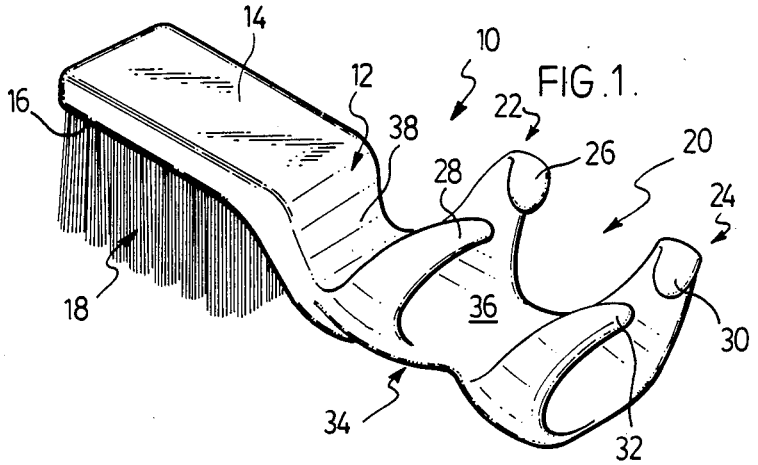
FIG. 1.
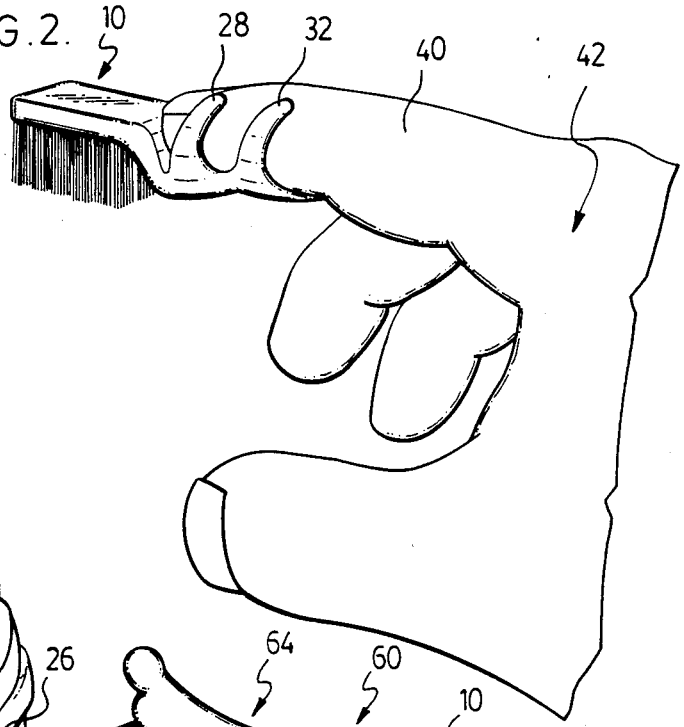
FIG. 2.
FIG. 3.
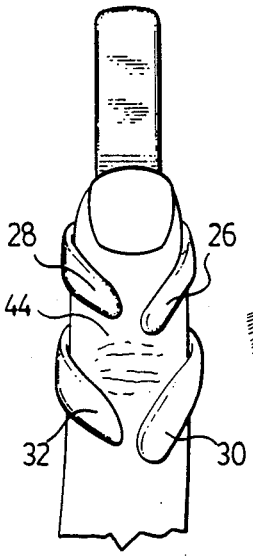
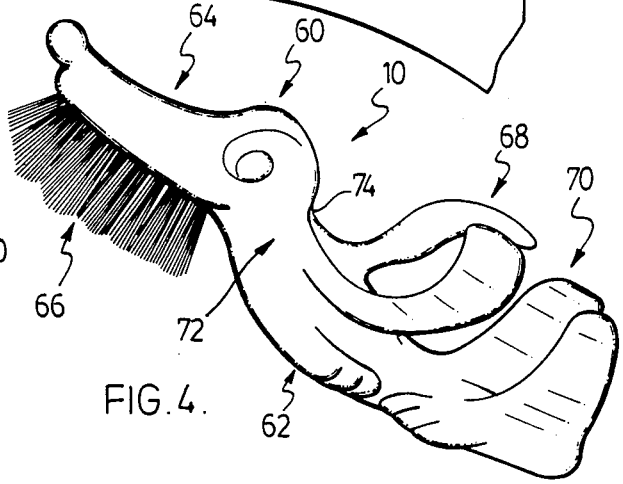
FIG. 4.

FINGER MANIPULATED ORAL HYGIENE DEVICE

FIELD OF THE INVENTION

This invention relates to oral hygiene devices and more particularly to devices which are mountable on the user's finger.

BACKGROUND OF THE INVENTION

The causes of periodontal diseases (destruction of the supporting structures of the teeth, i.e., gums and bone) are essentially unknown. However, one indisputable consideration is that in most cases the presence of plaque and tartar appears to be a major contributing factor in the progression of the disease. After periodontal therapy is instituted, the ultimate success of the treatment depends as much on the patient's ability to keep his or her gums free of plaque and tartar as it does on the doctor's competence.

In reality tooth and gum cleansing should not be a difficult task, but because one cannot directly observe 90% of oral cleansing, the task becomes time consuming and onerus. An additional hinderance to proper oral hygiene is the design of existing toothbrushes. Most people do not have the necessary dexterity to properly manipulate and cleanse with a conventional brush head that is mounted on a hand grip when it is five to six inches long. People go through cleaning motion, but do not clean. In most instances, people just initiate tooth brushing primarily as an exercise in carrying toothpaste, a mouth freshening vehicle, to get rid of bad taste and reduce the fear of having offensive breath.

Even though for years users (particularly those who are handicapped or arthritic) of long handled toothbrushes have had problems with maneuvrability and control, the design has not appreciably changed over two centuries. The use of an extended handled toothbrush for brushing eliminates the possibility of meaningful, spontaneous tactile sensation when attempting to differentiate between the various tissues in the oral cavity during tooth and gum cleansing. However, most people can readily touch with their finger any particular area in the oral cavity without any difficulty because of the reliance placed on the tactile sense.

Various attempts have been made in providing finger mounted toothbrushes. However, they have been designed from the standpoint of disposability and compactness of shape for travel use. U.S. Pat. No. 1,611,510 discloses a toothbrush in the shape of a tube having formed thereon a plurality of ribs. The device may be formed of fabric or other suitable material and used to clean one's teeth and then simply discard the device. Similar types of finger mountable tubes having various cleaning surfaces thereon are also disclosed in U.S. Pat. Nos. 1,894,413, 2,151,846, 2,167,129 and 2,968,827. All of these devices encompass the end of a finger and extend down to at least the second finger joint where the tube is sufficiently flexible to be gripped by the finger during use. An improvement on the design for the tube-type finger mountable toothbrush is disclosed in U.S. Pat. No. 4,134,172. A rubber tube has a brush portion mounted on the base thereof. The brush portion may include a clip which encompasses the rubber to assist in gripping the person's finger. The rubber expands to conform to the shape of the user's finger where the rubber tube extends rearwardly of at least the second joint of the user's finger. By the mounting of the brush on the base of the rubber tube and thereby locating the finger over top of the brush, bulkiness is added to the unit which makes it very difficult to manipulate the device in all areas of the oral cavity.

The major drawback with the devices of these patents is the encapsulation of the finger. This prevents taking advantage of the tactile sense to assist in properly locating the oral hygiene device in the desired areas of the oral cavity to affect cleansing of the tooth and gum area. An additional significant problem with the finger manipulated toothbrushes is that, if reuse is desired, it is very difficult to cleanse the closed end tubular portion of the brush. This results in unsightly, undesirable accumulation of material within the tube of the brush which discourages reuse. In this respect, a finger mountable tooth cleaner is disclosed in U.S. Pat. No. 3,798,698 which is worn in a manner similar to a ring, thereby leaving the end of the finger free to explore the oral cavity in providing a cleansing action. The brush, however, is provided at the base of the finger which adds to the bulkiness of the unit and furthermore the type of mounting in surrounding the finger does not provide a secure connection which would prevent rotation of the brush during use.

The objective of a finger mounted oral hygiene device should be to take advantage of a tactile sense in using the finger for manipulating the working head of device, whereby one can easily remove a maximum amount of plaque and debris in the oral cavity in a time frame one is accustomed to reserving for this purpose.

SUMMARY OF THE INVENTION

According to an aspect of the invention, an oral hygiene device for mounting on and manipulated by a user's finger comprises a stem, an oral hygiene working head provided on the stem and means for mounting the stem on the user's finger. The stem has upper and lower surfaces. The working head is provided on the stem lower surface and the mounting means is provided on the stem and extends upwardly relative to the stem. The working head is offset from the mounting means along the stem. The stem has a stepped portion between the working head and the mounting means to elevate thereby a portion of the stem provided with the working head relative to a portion of the stem provided with the mounting means.

According to a preferred aspect of the invention, the mounting means comprises two pairs of lugs. The lugs of each pair oppose one another across the stem and the pairs of lugs are spaced apart along the stem a sufficient distance to position the pairs of lugs to each side of first knuckle of the user's finger when the device is in use. The lugs extend upwardly from the stem upper surface and engage a corresponding portion of the user's finger to clamp the user's finger between opposing lugs of the pairs of lugs to mount securely thereby the oral device on the user's fingers.

BRIEF DESCRIPTION OF THE DRAWINGS

Preferred embodiments of the invention are shown in the drawings wherein:

FIG. 1 is a perspective view of the oral hygiene device according to a preferred embodiment of this invention;

FIG. 2 is a perspective view of the device of FIG. 1 mounted on a person's finger;

FIG. 3 is a top plan view of the oral device of FIG. 1 mounted on a person's finger;

FIG. 4 is a perspective view of an oral cleaning device according to another aspect of the invention;

DETAILED DESCRIPTION OF THE PREFERRED EMBODIMENTS

Figure 5:
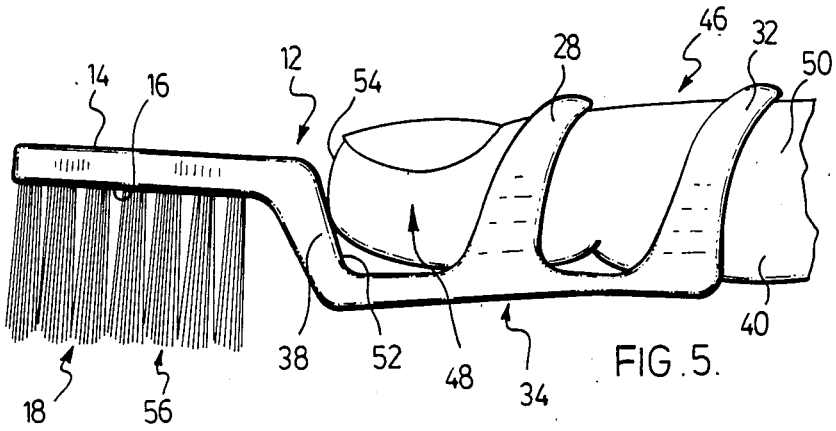
FIGS. 5 and 6 are side elevations of the oral cleaning device of FIG. 1 mounted on a person's finger and demonstrating manipulation thereof.

There are a variety of configurations for oral hygiene devices which include toothbrushes, gum stimulators, rubber cups, sponge pads for the administration of medicament, wooden picks, hard rubber stimulators, terry cloth pads, interproximal bristle devices and the like. The preferred embodiment of this invention will be described with reference to an oral hygiene device in the form of a toothbrush 10 as shown in FIG. 1 The device includes a stem generally designated 12 having upper and lower surfaces 14 and 16. To the lower surface 16 the working head of the oral hygiene device is mounted which, according to this embodiment, is a plurality of bristles 18. At the other end, the finger mounting device 20 is provided on the stem 12. According to this particular embodiment, the mounting device consists of two pairs 22 and 24 of individual opposing lugs 26 and 28 in the first pair and 30 and 32 in the second pair. Preferably the stem 12 extends to the underside 34 of the mounting device to form a base portion 36 for the mounting device. To enhance securement and feel in using the toothbrush, the base portion 36 of the mounting means may be roughened to increase frictional engagement of the finger fat pads with the base to provide a more secure feel during use.

To provide for a compactness of the oral cleaning device when placed in the user's mouth, the stem 12 is adapted to position the bristle ends upwardly in the region of the extension of a user's finger. According to the embodiment of FIG. 1, this is accomplished by a stepped portion 38 in the stem which positions the lower surface 16 of the stem above the lower portion 34 of the mounting device.

The stem 12 can be formed from any suitable plastics material which, for example, may be of the type commonly used in the manufacture of existing types of toothbrush handles. This facilitates known techniques for mounting the bristles 18 in the stem underside 16. The same type of plastic may be used in forming the finger mounting device 20. Such plastic is essentially rigid, yet has a degree of flexibility to permit outward spreading of the opposing lugs of the two pair 22 and 24 to permit fitment of the mounting device on the user's finger. To provide for universality in the mounting of the device on the user's finger, depending upon child, youth or adult size, the plastic for the mounting device may be of the type which expands resiliently to conform to the particular shape of the user's finger to provide a comfortable, yet secure snug mounting of the oral hygiene device on the user's finger.

With reference to FIG. 2, the device 10 is mounted on the user's digit finger 40 of the user's hand 42. The opposing lugs 26, 28 and 30 and 32 may be spread apart to permit fitment of the finger between the lugs. The lugs, when relaxed, attempt to resume their normal position due to the resilient nature of the plastic to clamp the finger between the opposing lugs of the two pairs where the user's finger is larger than the spacing between the lugs.

As shown in FIG. 3, the opposing sets of lugs 26, 28, 30 and 32 extend upwardly in a curved manner to surround the upper portion 44 of the user's finger to enhance the secure mounting of the finger on the oral hygiene device. The lugs in their upper regions are of thinner material to permit squeezing of the finger tissue to enhance and provide a comfortable, secure fitment to the finger. The lug positioning on the user's finger may be improved by offsetting the lug tips to the extent shown in FIG. 3 to provide a secure grip about the user's knuckle which is discussed in more detail with respect to FIGS. 5 and 6.

Various types and families of plastics which are useful in forming this type of device are readily available. Examples of suitable plastic resins include polycarbonates, Nylon (trademark), polystyrenes, polypropylene, acrylic and cellulose acetate butyrate.

Figure 6:
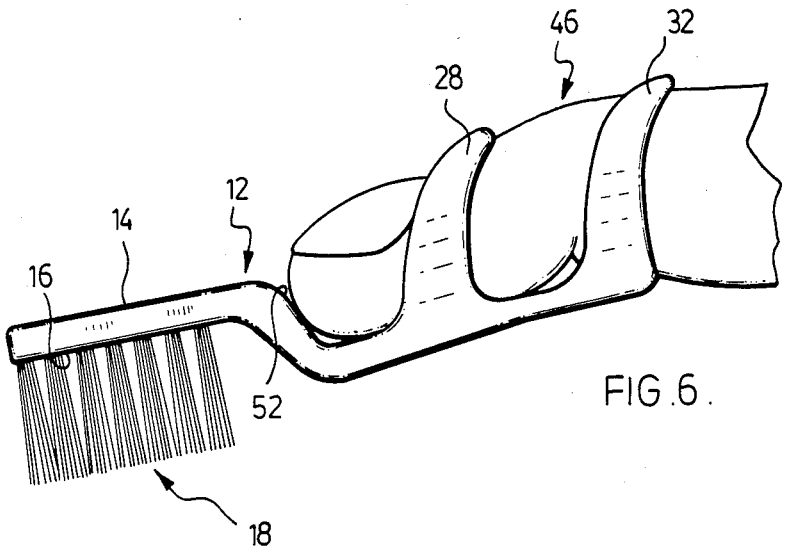

With reference to FIGS. 5 and 6, the manner in which the finger device is fitted to the finger is shown in more detail. The user's finger 40 has a first knuckle in the region 46 with the fat pad of the distal phalanx 48 located forwardly of the finger joint 46 and fat pad 50 of the central phalanx behind the joint 46. The opposing pairs of lugs are positioned so as to be located forwardly and rearwardly of the finger joint 46. This provides for the best gripping action about the fat pads while allowing some maneuverability of the finger joint 46 to the extent illustrated in FIG. 6. This allowed flexing of the finger joint enhances maneuvering and positioning of the working head in the person's oral cavity. Preferably the lugs of each pair slope rearwardly in the manner shown in FIG. 3 to avoid any biting action into the nail and to firmly grip the finger tissue behind the nail. As discussed with respect to FIG. 6, this allows a degree of flexing of the knuckle during use.

The stepped portion 38 in the stem 12 provides a stop 52 for the finger tip end 54 to ensure proper positioning of the finger relative to the lugs of the mounting device. In addition, the stop 52 enhances control of the brushing head and also ensures that the finger does not slide forwardly over the brush during brushing action.

As discussed with respect to FIG. 1, the stepped portion 38 also serves the purpose of providing a more compact dental cleaning device when viewed from the vertical plane. The stepped portion elevates the bristle ends 56 upwardly towards the lower portion 34 of the mounting device. To facilitate brushing of molars, the bristle ends project slightly below the bottom portion 34 of the mounting device to ensure that the bottom portion 34 of the device clears the molars and gums during horizontal brushing action.

The mounting device with the opposing pairs of lugs, which grip only portions of the finger in advance and behind the user's knuckle thereby leaving the distal end of the finger exposed, ensures a tactile sense during use of the oral hygiene device. Furthermore by the use of the lugs in providing for the mounting of the oral hygiene device on the finger, the mounting device is left open to provide for rinsing of the oral cleaning device to ensure that there is no unslightly residue remaining on the device after use.

The type of mounting also provides for conforming of the clamp lugs to various shapes of fingers, particularly those who suffer from arthritis or who are handicaped. A normal toothbrush is very awkward for the handicap to handle, whereas the system which mounts the brush directly on the finger provides the handicap with a better chance to achieve proper oral hygiene while reducing frustration in the exercise. With this type of oral hygiene device, one then substitutes a feel of sense for sight in the cleansing of the tooth and gum area. In essence one practically palpates the different areas with ease which provides a great improvement over the quality of care provided with conventional toothbrushes. In providing for increased manual dexterity in the cleansing action of teeth and gum, one then easily removes the maximum amount of plaque and debris in the normal amount of time spent brushing teeth. As noted with respect to FIG. 3, the lugs may be slightly offset so as to increase their retentive effectiveness in the synergistic compression of the muscle pad in the distal and central phalanx of the user's finger. To enhance the manipulation of the device, the working head of the device is tilted relative to the mounting means to the extent shown in FIG. 5. Easy access is provided to the lower jaw region to facilitate better brushing of the teeth and also improve access to the gum tissue especially in the lower tongue side and upper palatal to enhance oral hygiene.

Figure 7:
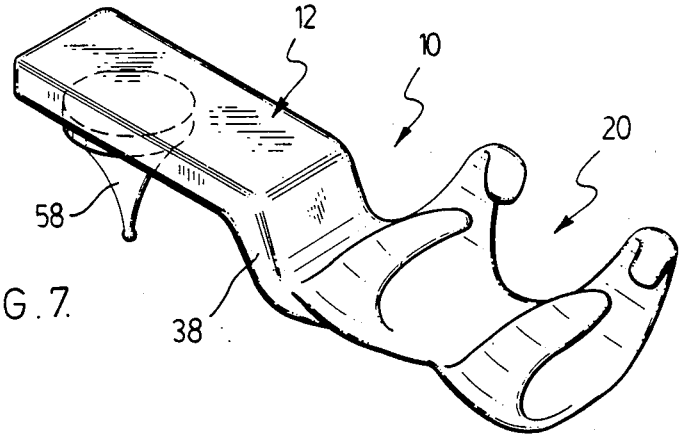
FIG. 7 is a perspective view of an oral cleaning device according to another embodiment of the invention.

As noted, a variety of working heads may be provided on the oral hygiene device, an example of which is shown in FIG. 7 where the oral hygiene device 10 has the usual mounting device 20. At the opposite portion of the stem 12 is a rubber gum stimulator 58 which is used for messaging the gum tissue between teeth. In a similar manner, other types of gum, tooth cleaning and prophylactic devices may be used and secured to the leading portion of the stem.

In accordance with another embodiment of the invention, the overall shape of the oral hygiene device may be ornamented in a way to provide a device which is particularly attractive to children With reference to FIG. 4, the body portion of the oral hygiene device 10 has a stem portion 60 which is molded in the shape of a puppy having a lower body portion 62 and a nose portion 64 to which the working head in the form of bristles 66 are secured. Pairs of opposing lugs 68 and 70 are provided which operates in the same manner as the pairs of lugs 22 and 24 of FIG. 1 for purposes of mounting the oral hygiene device 10 on the user's finger. The bristles 66, as provided on the head portion of the device, are arranged in a splayed configuration which enhances the brushing action and takes advantage of the special arrangement for the finger manipulated oral hygiene device. The ornamentation, as added to the body portion of the stem for the device, is attractive to children. During use, the children can, by appropriate finger movement, simulate motion of the animal to provide a degree of play element to the aspect of oral hygiene.

The oral cleaning device 10 of FIG. 4, as mounted on the user's finger by lugs 68 and 70, includes in its overall shape the stepped region 72 to elevate the bristles to the extent illustrated and discussed with respect to FIG. 5. Furthermore the stepped region 72 presents a stop 74 which functions to locate the finger properly in the oral hygiene device for use.

By way of this special design for a finger manipulated oral hygiene device, tests have shown that use by a variety of people have greatly improved oral hygiene. The device provides greater control in its use so that problem areas in the oral cavity can be readily located and successful cleansing action exerted on the gum tissue and teeth. The flow through design of the mounting device provides for easy cleaning but also ensures a secure feel in using the item. Because of the compact nature of the oral hygiene device, it also is easily packed for purposes of travel and/or use in the office or other public places. The openness provided by the lug arrangement facilitates the use of the tactile sense to assist in the location of the brushing action about the gums and teeth. It is appreciated that the oral hygiene device may be used upside down. The lugs are sufficiently resilient to grip the user's finger when positioned upside down on the user's finger to facilitate brushing certain areas in the oral cavity by those who desire the reverse mounting.

Although preferred embodiments of the invention have been described herein in detail, it will be understood by those skilled in the art that variations may be made thereto without departing from the spirit of the invention or the scope of the appended claims.

The embodiments of the invention in which an exclusive property or privilege is claimed are defined as follows:

1. An oral hygiene device for mounting on and manipulated by a user's finger, said device comprising a stem, an oral hygiene working head provided on said stem, and means for mounting said stem on a user's finger, said stem having upper and lower surfaces, said working head being provided on said stem lower surface and said mounting means being provided on said stem and extending upwardly relative to said stem, said working head being offset from said mounting means along said stem, said stem having a stepped portion between said working head and said mounting means to elevate thereby a portion of said stem provided with said working head relative to a portion of said stem provided with said mounting means, wherein said mounting means comprises two pairs of lugs, said lugs of each pair opposing one another across said stem and said pairs of lugs being spaced apart along said stem a sufficient distance to position said pairs of lugs to each side of a first knuckle of a user's finger when said device is in use, said lugs extending upwardly from said stem upper surface and being curved towards one another to conform to a contour of a user's finger, said lugs overlying an upper portion of a user's finger, said lugs engaging a corresponding portion of a user's finger to clamp a user's finger between opposing lugs of said pairs of lugs to mount securely thereby said oral device on a user's finger, said stepped portion of said stem provides a stop for an end of a user's finger when clamped by said pairs of lugs.

2. An oral hygiene device of claim 1, wherein an overall extent of said device is less than a user's finger length.

3. An oral hygiene device of claim 1, wherein said mounting means is formed of a resilient plastic, said lugs gripping a user's finger, said lugs being sufficiently thin to permit a degree of resilient spreading of opposing lugs when placing said device on a user's finger.

4. An oral hygiene device of claim 1, wherein said working head comprises a plurality of toothbrush bristles extending downwardly from said stem lower surface, said mounting means being integral with said stem where said stem lower surface extends beneath said mounting means, said stem thereby providing a base for said mounting means, said stepped portion of said stem positioning said bristle ends slightly below a plane defined by said stem lower surface beneath said mounting means.

5. An oral hygiene device of claim 4, wherein said stem and mounting means are formed of a suitable non-toxic plastics material, said lugs being resiliently spreadable to permit placement of said device on a user's finger.

6. An oral hygiene device of claim 5, wherein said stem portion having said bristles is angled upwardly relative to said base of said mounting means.

7. An oral hygiene device of claim 4, wherein said bristles are splayed.

8. An oral hygiene device of claim 1, wherein said lugs provide maximum exposure of user's finger tissue to enhance a tactile sense of oral use of said device.

9. An oral hygiene device of claim 4, wherein said base of said mounting means has a roughened surface to enhance a secure mounting of said device on a user's finger.

10. An oral hygiene device of claim 1, wherein said lugs of each pair of lugs are offset in a direction along the length of said device.

11. An oral hygiene device of claim 1 wherein each said lug of each of said two pairs of lugs slopes rearwardly away from said stepped portion.

* * * * *